US010106289B2

(12) United States Patent
Martinez

(10) Patent No.: US 10,106,289 B2
(45) **Date of Patent: *Oct. 23, 2018**

(54) BLANK AND METHODS OF CONSTRUCTING A CONTAINER FROM THE BLANK

(71) Applicant: WestRock Shared Services, LLC, Norcross, GA (US)

(72) Inventor: Gayle Katherine Martinez, Worchester, MA (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/830,611

(22) Filed: Dec. 4, 2017

(65) Prior Publication Data

US 2018/0086494 A1 Mar. 29, 2018

Related U.S. Application Data

(63) Continuation of application No. 15/174,492, filed on Jun. 6, 2016, now Pat. No. 9,850,022, which is a continuation of application No. 14/715,284, filed on May 18, 2015, now Pat. No. 9,359,102, which is a continuation of application No. 14/139,675, filed on Dec. 23, 2013, now Pat. No. 9,033,208, which is a (Continued)

(51) Int. Cl.

| | |
|---|---|
| ***B65D 5/00*** | (2006.01) |
| ***B65D 5/20*** | (2006.01) |
| ***B65D 5/24*** | (2006.01) |
| ***B65D 83/36*** | (2006.01) |
| ***B65D 85/36*** | (2006.01) |

(52) U.S. Cl.

CPC ..... *B65D 5/002* (2013.01); *B65D 5/0025* (2013.01); *B65D 5/2019* (2013.01); *B65D 5/2033* (2013.01); *B65D 5/241* (2013.01); *B65D 85/36* (2013.01); *B65D 2585/366* (2013.01); *Y10S 229/902* (2013.01)

(58) Field of Classification Search

CPC .... B65D 5/0025; B65D 5/002; B65D 5/2019; B65D 2585/366

USPC ..... 229/902, 906, 110, 170, 177, 178, 179, 229/187, 190, 191; 493/162

See application file for complete search history.

(56) References Cited

U.S. PATENT DOCUMENTS 5,402,929 A * 4/1995 Ritter ..... B65D 5/2033 229/110
5,702,054 A * 12/1997 Philips ..... B65D 5/6664 229/110
6,092,715 A * 7/2000 Correll ..... B65D 5/2033 229/110

* cited by examiner

*Primary Examiner* — Christopher Demeree
(74) *Attorney, Agent, or Firm* — WestRock IP Legal

(57) ABSTRACT

A blank of foldable sheet material is provided. The blank includes a bottom panel, a first bottom side panel and a second opposing bottom side panel extending from opposing side edges of the bottom panel, and a front panel extending from a front edge of the bottom panel. The front panel includes opposing side edges. The blank also includes a first and a second diagonal panel extending from a front edge of the first and second bottom side panels, respectively, and a third and a fourth diagonal panel extending from each side edge of the front panel. The third and fourth diagonal panels have a length greater than a length of the first and second diagonal panels. The blank includes a first and a second corner panel, wherein the first corner panel is (Continued)

hingedly connected to the first and third diagonal panels and the second corner panel is hingedly connected to the second and fourth diagonal panels.

18 Claims, 3 Drawing Sheets

Related U.S. Application Data continuation of application No. 12/040,486, filed on Feb. 29, 2008, now Pat. No. 8,627,998.

BLANK AND METHODS OF CONSTRUCTING A CONTAINER FROM THE BLANK

REFERENCE TO RELATED APPLICATIONS

This application is a continuation application of U.S. patent application Ser. No. 15/174,492 filed Jun. 6, 2016, which is a continuation application of U.S. patent application Ser. No. 14/715,284 filed May 18, 2015 (now U.S. Pat. No. 9,359,102 issued Jun. 7, 2016), which is a continuation application of U.S. patent application Ser. No. 14/139,675 filed Dec. 23, 2013 (now U.S. Pat. No. 9,033,208 issued May 19, 2015), which is a continuation application of U.S. patent application Ser. No. 12/040,486 filed Feb. 29, 2008, (now U.S. Pat. No. 8,627,998 issued Jan. 14, 2014), the disclosures of each of which are hereby incorporated by reference in their entireties.

BACKGROUND OF THE INVENTION

The field of the invention relates generally to a container formed from a sheet of material, and more particularly to a container that includes a corner panel extending from a bottom panel and methods of constructing the container from a blank.

It is well known in the food industry, including the pizza industry, to provide a food product to a consumer that is packaged in film, foil, paperwrap, a box, or a container. Such containers provide a convenient package to carry the food product from the producer of the food product to a table or other location for consumption by the consumer of the food product. It is also convenient to place multiple containers in a bag, such as an insulated bag, so a customer and/or delivery person is able to carry those containers from the restaurant for consumption elsewhere. At least some of these containers may be time consuming to form.

At least one known container is formed from a blank that includes a top panel having a top front tab and a pair of top side panels extending therefrom. The blank also includes a bottom having a pair of bottom side panels, an outer front panel, and an inner front panel extending therefrom. To form the known container from such a blank, (1) the bottom side panels are rotated into position with respect to a bottom panel, (2) front tabs extending from the bottom side panels are rotated to form right angles with the bottom side walls, (3) the front tabs are interlocked between the outer front panel and the inner front panel by rotating the inner front panel about the front tabs and interlocking the inner front panel with the bottom panel, (4) back tabs extending from the bottom side panels are rotated to form right angles with the bottom side walls, (5) the bottom side panels are rotated into position with respect to a top panel, (6) the top front tab is rotated into position with respect to a top panel, and (7) the top panel is rotated to be parallel to the bottom panel and the top front tab is received against the inner front panel. As such, forming a known container may be time consuming, especially when many of such known containers are formed.

BRIEF DESCRIPTION OF THE INVENTION

In one aspect, a blank of foldable sheet material is provided. The blank includes a bottom panel, a first bottom side panel and a second opposing bottom side panel extending from opposing side edges of the bottom panel, and a front panel extending from a front edge of the bottom panel. The front panel includes opposing side edges. The blank also includes a first and a second diagonal panel extending from a front edge of the first and second bottom side panels, respectively, and a third and a fourth diagonal panel extending from each side edge of the front panel. The third and fourth diagonal panels have a length greater than a length of the first and second diagonal panels. The blank includes a first and a second corner panel, wherein the first corner panel is hingedly connected to the first and third diagonal panels and the second corner panel is hingedly connected to the second and fourth diagonal panels.

In another aspect, a container formed from a blank of foldable sheet material is provided. The container includes a bottom wall and a front wall hingedly connected to the bottom wall. The front wall including a front panel having opposing side edges. The container also includes a first bottom side wall and an opposing second bottom side wall hingedly connected to the bottom wall, a first and a second diagonal wall extending from a front edge of the first and second bottom side walls respectively, and a third and a fourth diagonal wall extending from each side edge of the front panel. The third and fourth diagonal walls have a length greater than a length of the first and second diagonal walls. The container includes a first and a second corner panel, wherein the first corner panel is hingedly connected to the first and third diagonal walls and the second corner panel is hingedly connected to the second and fourth diagonal walls. The corner panels overlap and are substantially parallel to the bottom wall.

In still another aspect, a method of constructing a container from a blank of foldable sheet material is provided. The blank includes a bottom panel, a first bottom side panel and a second opposing bottom side panel extending from opposing side edges of the bottom panel, and a front panel extending from a front edge of the bottom panel. The front panel includes opposing side edges. The blank also includes a first and a second diagonal panel extending from a front edge of the first and second bottom side panels respectively, a third and a fourth diagonal panel extending from each side edge of said front panel, and a first and a second corner panel. The first corner panel is hingedly connected to the first and third diagonal panels, and the second corner panel is hingedly connected to the second and fourth diagonal panels. The third and fourth diagonal panels have a length greater than a length of the first and second diagonal panels. The method includes rotating the first and second corner panels about respective fold lines toward the bottom panel to form a front wall and a pair of opposing bottom side walls, wherein the front wall includes the front panel and the third and fourth diagonal panels.

DETAILED DESCRIPTION OF THE INVENTION

The following detailed description illustrates the disclosure by way of example and not by way of limitation. The description clearly enables one skilled in the art to make and use the disclosure, describes several embodiments, adaptations, variations, alternatives, and use of the disclosure, including what is presently believed to be the best mode of carrying out the disclosure.

The present invention provides a stackable, collapsible container that includes a corner panel extending from a bottom panel, and a method for constructing the container. The container is constructed from a blank of sheet material using a machine. In one embodiment, the container is fabricated from a paperboard material. The container, however, may be fabricated using any suitable material, and therefore is not limited to a specific type of material. In alternative embodiments, the container is fabricated using cardboard, plastic, fiberboard, paperboard, foamboard, corrugated paper, and/or any suitable material known to those skilled in the art and guided by the teachings herein provided.

In an example embodiment, the container includes at least one marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclee, pen and ink, painting, offset lithography, flexography, relief print, rotogravure, dye transfer, and/or any suitable printing technique known to those skilled in the art and guided by the teachings herein provided. In another embodiment, the container is void of markings, such as, without limitation, indicia that communicates the product, a manufacturer of the product and/or a seller of the product. Furthermore, the container may have any suitable size, shape and/or configuration, i.e., any suitable number of sides having any suitable size, shape and/or configuration as described and/or illustrated herein. In one embodiment, the container includes a shape that provides functionality, such as a shape that facilitates packaging a food item, a shape that facilitates transporting the container, and/or a shape that facilitates stacking and/or arrangement of a plurality of containers.

Figure 1:
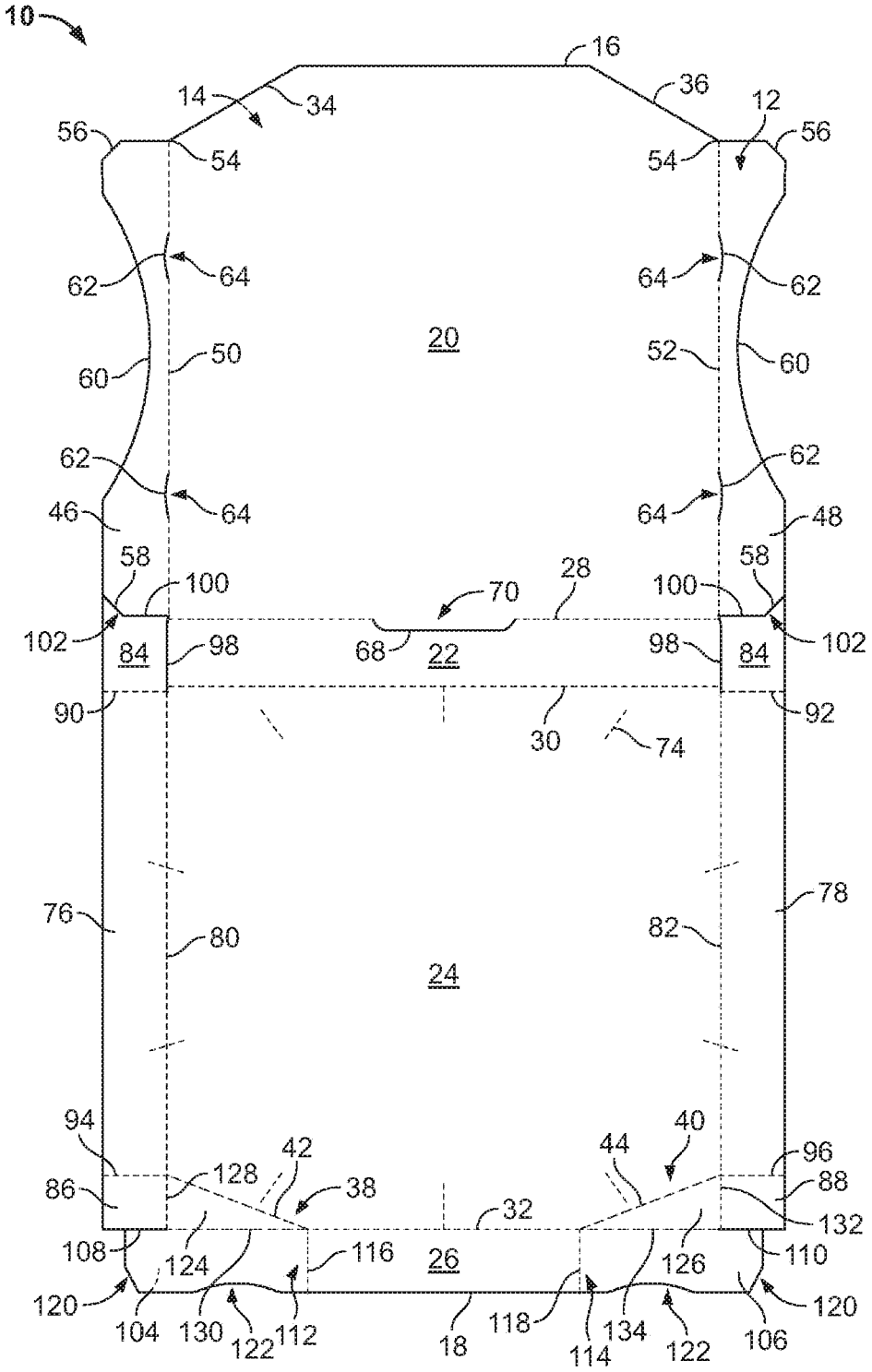
FIG. 1 is a top plan view of a blank of sheet material for constructing a container according to one embodiment of the present invention.
Figure 2:
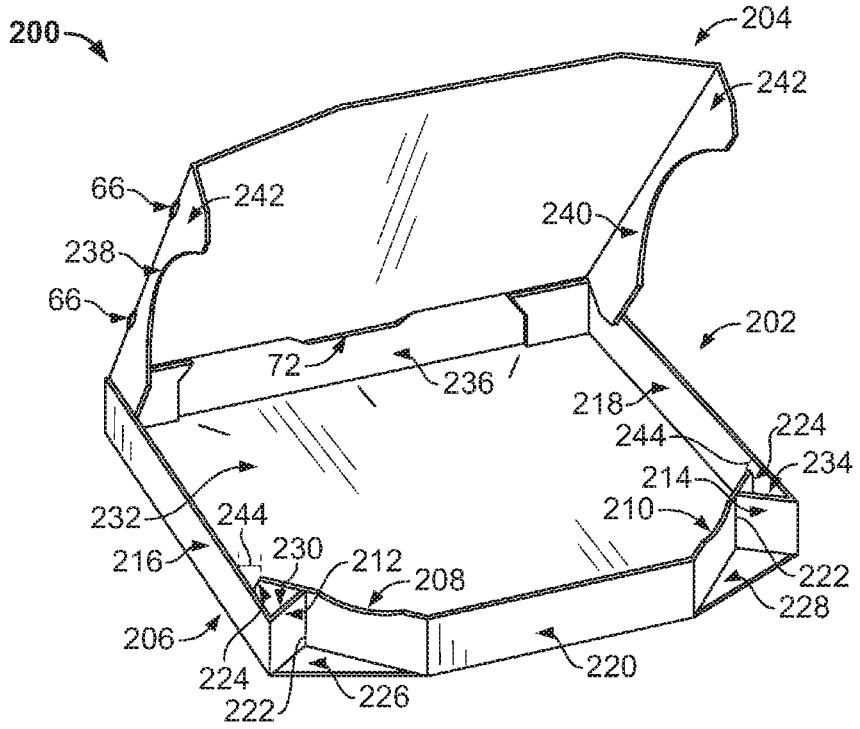
FIG. 2 is a perspective view of a container formed from the blank shown in FIG. 1.

Referring now to the drawings, and more specifically to FIGS. 1 and 2, although as described above a container may have any suitable size, shape and/or configuration, FIGS. 1 and 2 illustrate the construction or formation of one embodiment of a container. Specifically, FIG. 1 is a top plan view of one embodiment of a blank 10 of sheet material. FIG. 2 is a perspective view of one embodiment of a container 200 formed from blank 10 shown in FIG. 1.

Referring to FIG. 1, blank 10 has a first or interior surface 12 and an opposing second or exterior surface 14. Further, blank 10 defines a leading edge 16 and an opposing trailing edge 18. Blank 10 includes, from leading edge 16 to trailing edge 18, a top panel 20, a back panel 22, a bottom panel 24, and a front panel 26, coupled together along preformed, generally parallel, fold lines 28, 30, and 32, respectively. More specifically, back panel 22 extends from top panel 20 along fold line 28, bottom panel 24 extends from back panel 22 along fold line 30, and front panel 26 extends from bottom panel 24 along fold line 32. Fold lines 28, 30, and 32, as well as other fold lines and/or hinge lines described herein, may include any suitable line of weakening and/or line of separation known to those skilled in the art and guided by the teachings herein provided. Fold line 32 defines a front edge of bottom panel 24, and fold line 30 defines a back edge of bottom panel 24. Fold line 28 defines a back edge of top panel 20 and leading edge 16 defines a front edge of top panel 20.

Top panel 20 includes angled edges 34 and 36 extending from side edges of leading edge 16 such that leading edge 16 is narrower than fold line 28. Further, bottom panel 24 includes angled edges 38 and 40 that extend from fold line 32 such that fold line 32 is narrower than fold line 30. More specifically, angled edges 38 and 40 of bottom panel 24 are each defined by a respective fold line 42 and 44. In the exemplary embodiment, a width of leading edge 16 is approximately equal to a width of fold line 32, and angled edges 34, 36, 38, and 40 each have substantially the same width such that a shape of top panel 20 is substantially similar to a shape of bottom panel 24 Alternatively, top panel 20 and/or bottom panel 24 have any suitable shape that enables blank 10 to function as described herein.

Top panel 20 includes a first top side panel 46 and a second top side panel 48 extending therefrom along respective fold lines 50 and 52. More specifically, first top side panel 46 extends from top panel 20 along fold line 50, and second top side panel 48 extends from top panel 20 along fold line 52. Fold lines 50 and 52 define side edges of top panel 20. Each top side panel 46 and 48 extends a back edge 54 of a respective angled edge 34 or 36 such that top panel 20 is longer than top side panels 46 and 48. Alternatively, top panel 20 may be substantially the same length as top side panels 46 and/or 48. In the exemplary embodiment, first top side panel 46 and second top side panel 48 each include angled corners 56 and 58. Although each top side panel 46 and 48 is described as including angled corners 56 and 58, one or none of side top panels 46 and/or 48 may include angled corners 56 and/or 58.

Further in the exemplary embodiment, each top side panel 46 and 48 includes an arcuate edge 60. More specifically, arcuate edge 60 extends along a length of each top side panel 46 and 48 and is concave with respect to fold lines 50 and 52, respectively. As such, along arcuate edge 60, a width of each top side panel 46 and 48 varies according to the shape of arcuate edge 60. Although arcuate edge 60 is described herein, the edges of top side panels 46 and/or 48 may be other than arcuate. In an alternative embodiment, top side panels 46 and/or 48 do not include arcuate edge 60 such that the width of top side panels 46 and/or 48 is substantially constant along the length of top side panel 46 and/or 48.

In the exemplary embodiment, fold lines 50 and 52 include cut lines 62. More specifically cut lines 62 each define tab portions 64. When blank 10 is assembled to construct container 200, tab portions 64 extend from top side panels 46 and/or 48 and define an opening 66 (shown in FIG. 2) extending through container 200. Although cut lines 62 and tab portions 64 are shown and described as extending from fold lines 50 and 52 and/or top side panels 46 and 48, fold lines 50 and/or 52 and/or top side panels 46 and/or 48 are not required to include cut lines 62 and tab portions 64. In an alternative embodiment, fold lines 50 and/or 52 include more than two cut lines and/or more than two tabs.

Further, in the exemplary embodiment, fold line 28 includes a cut line 68. More specifically cut line 68 defines a tab portion 70. When blank 10 is assembled to construct container 200, tab portion 70 extends from top panel 20 and defines an opening 72 (shown in FIG. 2) extending through container 200. Although cut line 68 and tab portion 70 are shown and described as extending from fold line 28 and/or top panel 20, fold line 28 and/or top panel 20 is not required to include cut line 68 and tab portion 70. In an alternative embodiment, fold line 28 includes more than one cut line and/or more than one tab.

Bottom panel 24 includes a plurality of lines of weakness 74 circumferentially-spaced about a perimeter of bottom panel 24. In an alternative embodiment, lines of weakness 74 are oriented and/or arranged in any suitable manner with respect to bottom panel 24 that enables blank 10 to function as described herein. Alternatively, bottom panel 24 does not include lines of weakness 74. In the exemplary embodiment, bottom panel 24 includes a first bottom side panel 76 and a second bottom side panel 78 extending therefrom along respective fold lines 80 and 82. More specifically, first bottom side panel 76 extends from bottom panel 24 along fold line 80, and second bottom side panel 78 extends from bottom panel 24 along fold line 82. Fold lines 80 and 82 define side edges of bottom panel 24. Furthermore, each bottom side panel 76 and 78 includes a back tab 84 and a minor diagonal panel 86 and 88 extending from respective fold lines 90, 92, 94, and 96. More specifically, one back tab 84 extends from first bottom side panel 76 along fold line 90, one minor diagonal panel 86 extends from first bottom side panel 76 along fold line 94, one back tab 84 extends from second bottom side panel 78 along fold line 92, and one minor diagonal panel 88 extends from second bottom side panel 78 along fold line 96. Fold lines 90 and 92 define back edges of bottom side panels 76 and 78, and fold lines 94 and 96 define front edges of bottom side panels 76 and 78.

Each back tab 84 is separated from back panel 22 by a cut line 98, and further separated from an adjacent top side panel 46 or 48 by a cut line 100. Although, in the exemplary embodiment, cut lines 100 define an extension portion 102 adjacent to angled corners 58, cut lines 100 may be any suitable shape, size, and/or configuration that enables blank 10 and/or container 200 to function as described herein. In an alternative embodiment, back tabs 84 extend from top side panels 46 and 48 such that a fold line couples back tab 84 to a top side panel 46 or 48 and a cut line separates back tab 84 from bottom side panel 76 or 78. Further, minor diagonal panels 86 and 88 have a width that is approximately equal to a width of an adjacent bottom side panel 76 or 78. Each minor diagonal panel 86 and 88 is separated from an adjacent major diagonal panel 104 and 106 by a respective cut line 108 and 110.

Major diagonal panels 104 and 106 extend from each side edge 112 and 114 of front panel 26 at a respective fold line 116 or 118. More specifically, major diagonal panel 104 extends from front panel 26 along fold line 116, and major diagonal panel 106 extends from front panel 26 along fold line 118. Fold lines 116 and 118 define side edges of front panel 26. Major diagonal panels 104 and 106 have a greater length than minor diagonal panels 86 and 88, wherein the length of major diagonal panels 104 and 106 is measured between a respective fold line 116 or 118 and a side edge 224 of the major diagonal panel 104 or 106, and the length of minor diagonal panels 86 and 88 is measured between a respective fold line 94 or 96 and a front edge 222 of the minor diagonal panel 86 or 88. Front panel 26 together with major diagonal panels 104 and 106 are narrower than bottom panel 24 with bottom side panels 76 and 78. Alternatively, front panel 26 with major diagonal panels 104 and 106 are approximately the same width as bottom panel 24 with bottom side panels 76 and 78. Further, each major diagonal panel 104 and 106 includes an angled corner 120 and an arcuate edge 122. In an alternative embodiment, major diagonal panel 104 and/or 106 does not include angled corner 120 and/or arcuate edge 122. Moreover, in the exemplary embodiment, fold lines 42 and 44 that define angled edges 38 and 40 of bottom panel 24 extend, respectively, from minor diagonal panel fold line 94 to major diagonal panel fold line 116, and from minor diagonal panel fold line 96 to major diagonal panel fold line 118.

Corner panels 124 and 126 extends from bottom panel 24 along respective fold lines 42 and 44. A first corner panel 124 is hingedly connected to minor diagonal panel 86 at a fold line 128 and is hingedly connected to major diagonal panel 104 at a fold line 130, and a second corner panel 126 is hingedly connected to minor diagonal panel 88 at a fold line 132 and is hingedly connected to major diagonal panel 106 at a fold line 134. Fold lines 128 and 132 define bottom edges of minor diagonal panels 86 and 88, and fold lines 130 and 134 define bottom edges of major diagonal panels 104 and 106. Fold lines 130 and 134 are substantially collinear with fold line 32, fold line 128 is substantially collinear with fold line 80, and fold line 132 is substantially collinear with fold line 82.

To construct container 200 shown in FIG. 2 from blank 10 shown in FIG. 1, a base 202 of container 200 and a lid 204 of container 200 are formed. Referring to FIGS. 1 and 2, to form base 202, corner panels 124 and 126 are rotated about respective fold lines 42 and 44 toward interior surface 12 to overlap at least a portion of bottom panel 24. As rotated, corner panels 124 and 126 are substantially parallel to bottom panel 24 such that interior surface 12 of corner panels 124 and 126 is adjacent to interior surface 12 of bottom panel 24. Bottom panel 24 and overlapped corner panels 124 and 126 form a bottom wall 206.

When corner panels 124 and 126 are rotated toward interior surface 12, major diagonal panels 104 and 106, minor diagonal panels 86 and 88, bottom side panels 76 and 78, and front panel 26 are also rotated about respective fold lines 116, 130, 118, 134, 94, 128, 96, 132, 80, 82, and 32 toward interior surface because of the interconnectivity of major diagonal panels 104 and 106, minor diagonal panels 86 and 88, bottom side panels 76 and 78, and front panel 26 with corner panels 124 and 126. As such, major diagonal panels 104 and 106, minor diagonal panels 86 and 88, bottom side panels 76 and 78, and front panel 26 are rotated into position concurrently with corner panels 124 and 126 in one motion. Major diagonal panels 104 and 106 form respective major diagonal walls 208 and 210, and minor diagonal panels 86 and 88 form respective minor diagonal walls 212 and 214. Bottom side panels 76 and 78 form respective bottom side walls 216 and 218. Major diagonal walls 208 and 210, minor diagonal walls 212 and 214, and front panel 26 form a front wall 220.

Further, when corner panels 124 and 126 are rotated into position, front edges 222 of minor diagonal panels 86 and 88 contact an adjacent major diagonal panel 104 or 106, and side edges 224 of major diagonal panels 104 and 106 are adjacent to, but spaced from, an adjacent bottom side wall 216 or 218. Major diagonal walls 208 and 210, minor diagonal walls 212 and 214, and corner panels 124 and 126 form recesses 226 and 228 within front wall 220 at each side of front wall 220. Further, a chamber 230 is defined by bottom side wall 216, minor diagonal wall 212, and major diagonal wall 208 adjacent to recess 226 within a cavity 232 of base 202. Similarly, a chamber 234 defined by bottom side wall 218, minor diagonal wall 214, and major diagonal wall 210 adjacent to recess 228 within cavity 232 of base 202. Cavity 232 of base 202 also defines a cavity of container 200. More specifically, minor diagonal wall 212 separates chamber 230 from recess 226, and minor diagonal wall 214 separates chamber 234 from recess 228.

Back tabs 84 are rotated about respective fold lines 90 and 92 toward interior surface 12 to from a portion of a back wall 236 and at least partially define base cavity 232. Alternatively, back tabs 84 may be rotated into position before corner panels 124 and 126 are rotated toward interior surface 12. When back tabs 84 are rotated before corner panels 124 and 126 are rotated, the rotation of corner panels 124 and 126 rotates back tabs 84 into position to form a portion of back wall 236 concurrently with the rotation of panels 26, 76, 78, 86, 88, 104, and 106.

To construct lid 204 of container 200, top side panels 46 and 48 are rotated about respective fold lines 50 and 52 toward interior surface 12 to form top side walls 238 and 240. In an alternative embodiment, lid 204 is formed before base 202 is formed.

To close container 200, lid 204 is rotated toward base 202 along fold lines 28 and 30. As lid 204 is rotated toward base 202, back panel 22 is rotated about fold line 30 to form back wall 236. More specifically, back wall 236 is formed when back panel 22 is adjacent to back tabs 84. Further, exterior surface 14 of top side walls 238 and 240 contact interior surface 12 of bottom side walls 216 and 218 when lid 204 engages base 202. Front portions 242 of top side walls 238 and 240 are received within gaps 244 between major diagonal walls 208 and 210 and bottom side walls 216 and 218. Front portions 242 are further received within chambers 230 and 234. Prior to closing container 200, a product, such as a food product, may be placed within base 202. As such, when lid 204 engages base 202, the product is secured within cavity 232 by lid 204 and base 202.

As such, the following steps are performed to form container 200 from blank 10: (1) form front wall 220 and bottom side walls 216 and 218 by rotating corner panels 124 and 126 toward bottom wall 206; (2) rotate back tabs 84 toward interior surface 12 to form a portion of back wall 236; (3) form top side walls 238 and 240 by rotating top side panels 46 and 48 toward interior surface 12; and (4) close container 200 by rotating lid 204 toward base 202 and engaging top side walls 238 and 240 with bottom side walls 216 and 218. In an alternative embodiment, steps (1) and (2) are interchanged. In another alternative embodiment, step (3) is performed before steps (1) and (2).

Figure 4:
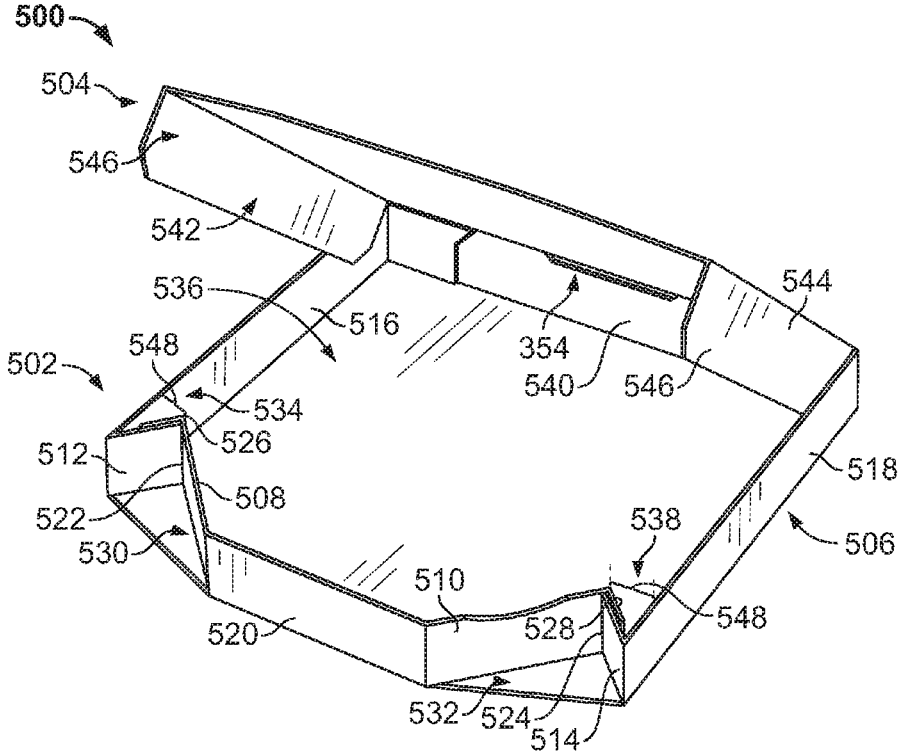
FIG. 4 is a perspective view of a container formed from the blank shown in FIG. 3.
Figure 3:
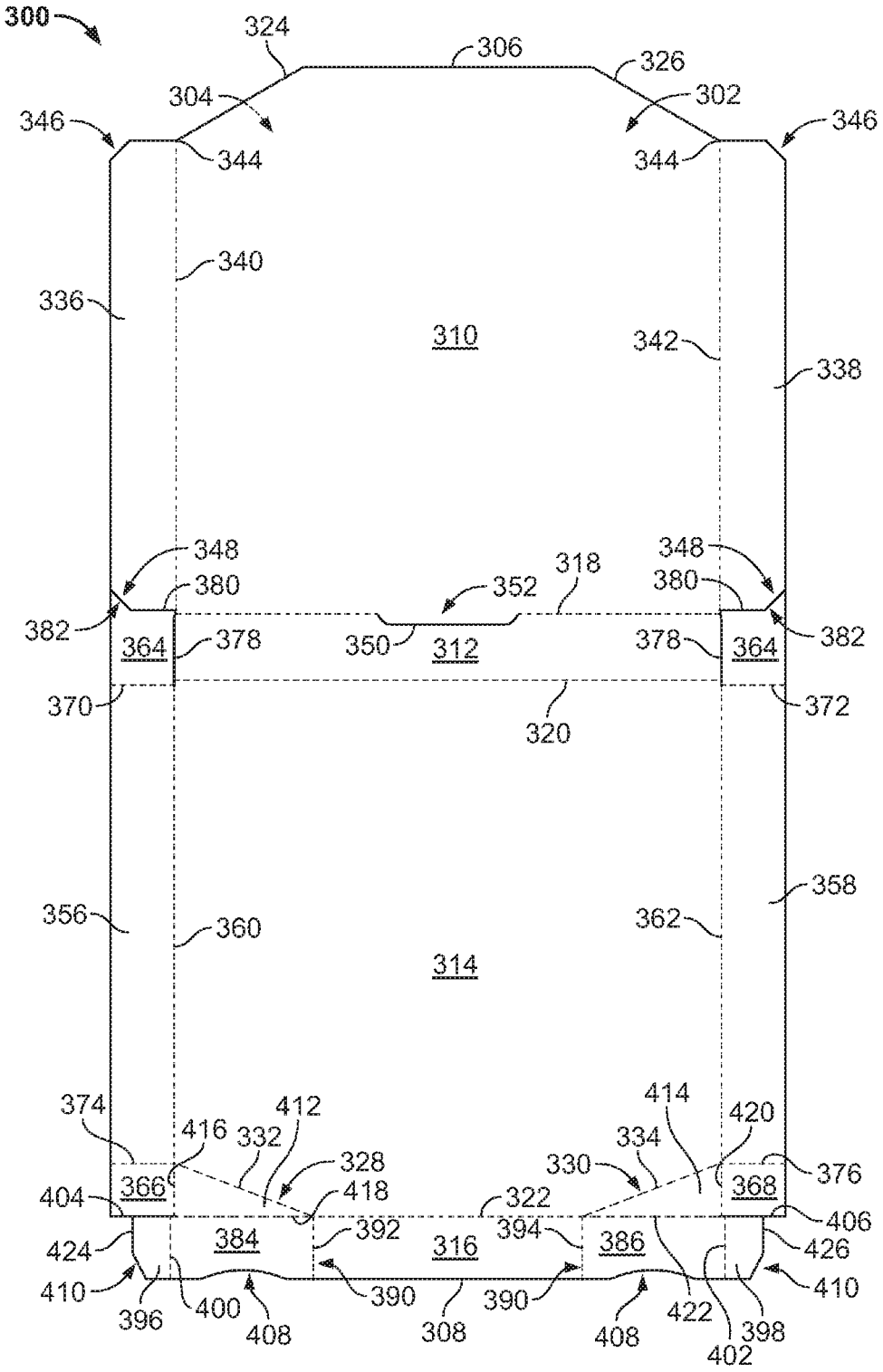
FIG. 3 is a top plan view of an outer surface of a blank of sheet material for constructing a container according to a first embodiment of the present invention.

FIGS. 3 and 4 illustrate a first example embodiment of the present invention. More specifically, FIG. 3 is a top plan view of a blank 300 of sheet material for constructing a container 500 according to the first example embodiment of the present invention. FIG. 4 is a perspective view of container 500 formed from blank 300 shown in FIG. 3.

Referring to FIG. 3, blank 300 has a first or interior surface 302 and an opposing second or exterior surface 304. Further, blank 300 defines a leading edge 306 and an opposing trailing edge 308. Blank 300 includes, from leading edge 306 to trailing edge 308, a top panel 310, a back panel 312, a bottom panel 314, and a front panel 316, coupled together along preformed, generally parallel, fold lines 318, 320, and 322, respectively. More specifically, back panel 312 extends from top panel 310 along fold line 318, bottom panel 314 extends from back panel 312 along fold line 320, and front panel 316 extends from bottom panel 314 along fold line 322. Fold lines 318, 320, and 322, as well as other fold lines and/or hinge lines described herein, may include any suitable line of weakening and/or line of separation known to those skilled in the art and guided by the teachings herein provided. Fold line 322 defines a front edge of bottom panel 314, and fold line 320 defines a back edge of bottom panel 314. Fold line 318 defines a back edge of top panel 310, and leading edge 306 defines a front edge of top panel 310.

Top panel 310 includes angled edges 324 and 326 extending from side edges of leading edge 306 such that leading edge 306 is narrower than fold line 318. Further, bottom panel 314 includes angled edges 328 and 330 that extend from fold line 322 such that fold line 322 is narrower than fold line 320. More specifically, angled edges 328 and 330 of bottom panel 314 are defined by fold lines 332 and 334. In the exemplary embodiment, a width of leading edge 306 is approximately equal to a width of fold line 322, and angled edges 324, 326, 328, and 330 each have substantially the same width such that a shape of top panel 310 is substantially similar to a shape of bottom panel 314. Alternatively, top panel 310 and/or bottom panel 314 have any suitable shape that enables blank 300 to function as described herein.

Top panel 310 includes a first top side panel 336 and a second top side panel 338 extending therefrom along respective fold lines 340 and 342. More specifically, first top side panel 336 extends from top panel 310 along fold line 340, and second top side panel 338 extends from top panel 310 along fold line 342. Fold lines 340 and 342 define side edges of top panel 310. Each top side panel 336 and 338 extends to a back edge 344 of a respective angled edge 324 or 326 such that top panel 310 is longer than top side panels 336 and 338. Alternatively, top panel 310 may be substantially the same length as top side panels 336 and/or 338. In the exemplary embodiment, first top side panel 336 and second top side panel 338 each include angled corners 346 and 348. Although each top side panel 336 and 338 is described as including angled corners 346 and 348, one or none of side top panels 336 and/or 338 may include angled corners 346 and/or 348. A width of top side panels 336 and/or 338 is substantially constant along the length of top side panel 336 and/or 338. In an alternative embodiment, top side panels 336 and/or 338 includes an arcuate edge, as described above.

Further, in the exemplary embodiment, fold line 318 includes a cut line 350. More specifically cut line 350 defines a tab portion 352. When blank 300 is assembled to construct container 500 (shown in FIG. 4), tab portion 352 extends from top panel 310 and defines an opening 354 (shown in FIG. 4) extending through container 500. Although cut line 350 and tab portion 352 are shown and described as extending from fold line 318 and/or top panel 310, fold line 318 and/or top panel 310 is not required to include cut line 350 and/or tab portion 352. In an alternative embodiment, fold line 318 includes more than one cut line and/or more than one tab.

Bottom panel 314 includes a first bottom side panel 356 and a second bottom side panel 358 extending therefrom along respective fold lines 360 and 362. More specifically, first bottom side panel 356 extends from bottom panel 314 along fold line 360, and second bottom side panel 358 extends from bottom panel 314 along fold line 362. Fold lines 360 and 362 define side edges of bottom panel 314. Furthermore, each bottom side panel 356 and 358 includes a back tab 364 and a minor diagonal panel 366 or 368 extending from respective fold lines 370, 372, 374, and 376. More specifically, one back tab 364 extends from first bottom side panel 356 along fold line 370, one minor diagonal panel 366 extends from first bottom side panel 356 along fold line 374, one back tab 364 extends from second bottom side panel 358 along fold line 372, and one minor diagonal panel 368 extends from second bottom side panel 358 along fold line 376. Fold lines 370 and 372 define back edges of bottom side panels 356 and 358, and fold lines 374 and 376 define front edges of bottom side panels 356 and 358.

Each back tab 364 is separated from back panel 312 by a cut line 378, and further separated from an adjacent top side panel 336 or 338 by a cut line 380. Although, in the exemplary embodiment, cut lines 380 define an extension portion 382 adjacent to angled corner 348, cut lines 380 may be any suitable shape, size, and/or configuration that enables blank 300 and/or container 500 to function as described herein. In an alternative embodiment, back tabs 364 extend from top side panels 336 and 338 such that a fold line couples back tab 364 to a top side panel 336 or 338 and a cut line separates back tab 364 from bottom side panel 356 or 358. Further, minor diagonal panels 366 and 368 have a width that is approximately equal to a width of an adjacent bottom side panel 356 or 358.

Major diagonal panels 384 and 386 extend from each side edge 390 of front panel 316 at a respective fold line 392 and 394. More specifically, major diagonal panel 384 extends from front panel 316 along fold line 392, and major diagonal panel 386 extends from front panel 316 along fold line 394. Fold lines 392 and 394 define side edges of front panels 316. Major diagonal panels 384 and 386 have a greater length than minor diagonal panels 366 and 368, wherein the length of major diagonal panels 384 and 386 is measured between a respective set of fold lines 116 or 118 and 400 or 402, and the length of minor diagonal panels 366 and 368 is measured between a respective fold line 374 or 376 and a front edge 522 and 524 of the minor diagonal panel 366 or 368.

Further, a first overlap flap 396 extends from major diagonal panel 384 along a fold line 400, and a second overlap flap 398 extends from major diagonal panel 386 along a fold line 402. Fold lines 400 and 402 define side edges of major diagonal panels 384 and 386, respectively. Each minor diagonal panel 366 and 368 is separated from an adjacent overlap flap 396 and 398 by a respective cut line 404 and 406. Each major diagonal panel 384 and 386 includes an arcuate edge 408. In an alternative embodiment, major diagonal panel 384 and/or 386 does not include arcuate edge 408. In the exemplary embodiment, each overlap flap 396 and 398 includes an angled corner 410. In an alternative embodiment, overlap flap 396 and/or 398 does not include angled corner 410.

In the exemplary embodiment, front panel 316 with major diagonal panels 384 and 386 and overlap flaps 396 and 398 is narrower than bottom panel 314 with bottom side panels 356 and 358. Alternatively, front panel 316 with major diagonal panels 384 and 386 and overlap flaps 396 and 398 is approximately the same width as bottom panel 314 with bottom side panels 356 and 358. Moreover, in the exemplary embodiment, fold lines 332 and 334 that define angled edges 328 and 330 of bottom panel 314 extend, respectively, from minor diagonal panel fold line 374 to major diagonal panel fold line 392, and from minor diagonal panel fold line 376 to major diagonal panel fold line 394.

Corner panels 412 and 414 extend from bottom panel 314 along respective fold lines 332 and 334. A first corner panel 412 is hingedly connected to minor diagonal panel 366 at a fold line 416 and is hingedly connected to major diagonal panel 384 at a fold line 418, and a second corner panel 414 is hingedly connected to minor diagonal panel 368 at a fold line 420 and is hingedly connected to major diagonal panel 386 at a fold line 422. Fold lines 416 and 420 define bottom edges of minor diagonal panels 366 and 368, and fold lines 418 and 422 define bottom edges of major diagonal panels 384 and 386. Fold lines 418 and 422 are substantially collinear with fold line 322, fold lines 400 and 416 are substantially collinear with fold line 360, and fold lines 402 and 420 are substantially collinear with fold line 362.

To construct container 500 shown in FIG. 4 from blank 300 shown in FIG. 3, a base 502 of container 500 and a lid 504 of container 500 are formed. Referring to FIGS. 3 and 4, to form base 502, corner panels 412 and 414 are rotated about respective fold lines 332 and 334 toward interior surface 302 to overlap at least a portion of bottom panel 314. As rotated, corner panels 412 and 414 are substantially parallel to bottom panel 314 such that interior surface 302 of corner panels 412 and 414 is adjacent to interior surface 302 of bottom panel 314. Bottom panel 314 and overlapped corner panels 412 and 414 form a bottom wall 506.

When corner panels 412 and 414 are rotated toward interior surface 302, major diagonal panels 384 and 386 with respective overlap flaps 396 and 398, minor diagonal panels 366 and 368, bottom side panels 356 and 358, and front panel 316 are also rotated about respective fold lines 392, 394, 418, 422, 374, 376, 416, 420, 360, 362, and 322 toward interior surface 302 because of the interconnectivity of major diagonal panels 384 and 386, minor diagonal panels 366 and 368, bottom side panels 356 and 358, and front panel 316 with corner panels 412 and 414. As such, major diagonal panels 384 and 386 with respective overlap flaps 396 and 398, minor diagonal panels 366 and 368, bottom side panels 356 and 358, and front panel 316 are rotated into position concurrently with corner panels 412 and 414 in one motion. Overlap flaps 396 and 398 are then rotated about respective fold lines 400 and 402 toward an adjacent minor diagonal panel 366 or 368 such that exterior surface of overlap flaps 396 and 398 is adjacent to interior surface of minor diagonal panels 366 and 368. Further, a side edge 424 and 426 of each overlap flap 396 and 398 is adjacent to a respective fold line 374 or 376 to facilitate locking a major diagonal panel 384 or 386 to an adjacent minor diagonal panel 366 or 368.

Major diagonal panels 384 and 386 form respective major diagonal walls 508 and 510, and minor diagonal panels 366 and 368 and overlap flaps 396 and 398 form respective minor diagonal walls 512 and 514. Bottom side panels 356 and 358 form respective bottom side walls 516 and 518. Major diagonal walls 508 and 510, minor diagonal walls 512 and 514, and front panel 316 form a front wall 520.

Further, when corner panels 412 and 414 are rotated into position, front edges 522 and 524 of minor diagonal panels 366 and 368, respectively, contact an adjacent major diagonal panel 384 or 386, and side edges 526 and 528 of major diagonal panels 384 and 386 are adjacent to, but spaced from, an adjacent bottom side wall 516 or 518. Major diagonal walls 508 and 510, minor diagonal walls 512 and 514, and corner panels 412 and 414 form recesses 530 and 532 within front wall 520 at each side of front wall 520. Further, a chamber 534 is defined by bottom side wall 516 and minor diagonal wall 512 adjacent to recess 530 within a cavity 536 of base 502. Similarly, a chamber 538 defined by bottom side wall 518 and minor diagonal wall 514 adjacent to recess 532 within cavity 536 of base 502. Cavity 536 of base 502 also defines a cavity of container 500. More specifically, minor diagonal wall 512 separates chamber 534 from recess 530, and minor diagonal wall 514 separates chamber 538 from recess 532.

Back tabs 364 are rotated about respective fold lines 370 and 372 toward interior surface 302 to from a portion of a back wall 540 and at least partially define base cavity 536. Alternatively, back tabs 364 may be rotated into position before corner panels 412 and 414 are rotated toward interior surface 302. When back tabs 364 are rotated before corner panels 412 and 414, rotation of corner panels 412 and 414 rotates back tabs 364 into position to form a portion of back wall 540 concurrently with the rotation of panels 316, 356, 358, 366, 368, 384, 386, 396, and 398.

To construct lid 504 of container 500, top side panels 336 and 338 are rotated about respective fold lines 340 and 342 toward interior surface 302 to form top side walls 542 and 544. In an alternative embodiment, lid 504 is formed before base 502 is formed.

To close container 500, lid 504 is rotated toward base 502 along fold lines 318 and 320. As lid 504 is rotated toward base 502, back panel 312 is rotated about fold line 320 to form back wall 540. More specifically, back wall 540 is formed when back panel 312 is adjacent back tabs 364. Further, exterior surface 304 of top side walls 542 and 544 contacts interior surface 302 of bottom side walls 516 and 518 when lid 504 engages base 502. Front portions 546 of top side walls 542 and 544 are received within gaps 548 between major diagonal wall side edges 526 and 528 and bottom side walls 516 and 518. Front portions 546 are further received within chambers 534 and 538. Prior to closing container 500, a product, such as a food product, may be placed within base 502. As such, when lid 504 engages base 502, the product is secured within cavity 536 by lid 504 and base 502.

As such, the following steps are performed to form container 500 from blank 300: (1) form front wall 520 and bottom side walls 516 and 518 by rotating corner panels 412 and 414 toward bottom wall 506; (2) form minor diagonal walls 512 and 514 by rotating overlap flaps 396 and 398 toward minor diagonal panels 366 and 368; (3) rotate back tabs 364 toward interior surface 302 to form a portion of back wall 540; (4) form top side walls 542 and 544 by rotating top side panels 336 and 338 toward interior surface 302; and (5) close container 500 by rotating lid 504 toward base 502 and engaging top side walls 542 and 544 with bottom side walls 516 and 518. In an alternative embodiment, step (3) is performed before steps (1) and (2). In another alternative embodiment, step (4) is performed before steps (1), (2) and/or (3).

The above-described container and methods of constructing the container provide a container that is easily constructed from a flexible unitary blank of paperboard in fewer steps than known containers. More specifically, the container described herein is constructed in fewer steps than the at least six steps as are required for known containers. Because the above-described container does not include a top front tab that is received behind a bottom front panel, construction of the container is simplified. Exclusion of the front tab also reduces the amount of material used to form the blank. Further, construction is simplified by the interconnection of the above-described corner panel with adjacent panels. The interconnection enables several walls to be constructed concurrently as the corner panel is rotated into an assembled position. Additionally, the curved edge of the major diagonal panels facilitates increasing the ease of assembly by reducing the distance a user's hand extends during construction of the container. For example, the user may position a thumb against the curved edge as the corner panels are rotated into position, and the curved edge reduces the extent that the user's thumb extends. Moreover, the angled corners of the top side panels facilitate guiding the top side panels into the chambers formed within the base.

Furthermore, the front corner construction improves the strength of the container, as compared to known containers. Moreover, the arcuate edges of the top side panels prevents a product, such as a pizza, from contacting the top side walls as the lid is rotated into engagement with the base.

Exemplary embodiments of a container that includes a corner panel extending from a bottom panel have been described above in detail. The container is not limited to the specific embodiments described herein, but rather, components of the container and/or steps of the method may be utilized independently and separately from other components and/or steps described herein. Further, the described components and/or method steps can also be defined in, or used in combination with, other apparatus and/or methods, and are not limited to practice with only the apparatus and method as described herein.

While the invention has been described in terms of various specific embodiments, those skilled in the art will recognize that the invention can be practiced with modification within the spirit and scope of the claims.

What is claimed is:

1. A blank of foldable sheet material for forming a container, said blank comprising:

a top panel;

a first top side panel extending from a first side edge of said top panel;

a bottom panel;

a first bottom side panel extending from a first side edge of said bottom panel;

a front panel extending from a front edge of said bottom panel;

a first major diagonal panel extending from a first side edge of said front panel along a first fold line and extending to a first terminal edge;

a first minor diagonal panel extending from a front edge of said bottom side panel along a second fold line and extending to a second terminal edge;

wherein the blank is configured so that when formed into the container, the first terminal edge is proximate an inside surface of the first bottom side panel so as to define a gap between said first terminal edge and said inside surface of said first bottom side panel, said gap configured to receive a portion of said first top side panel when the container is closed;

wherein the blank is configured so that when formed into the container, the second terminal edge contacts an outside surface of the first major diagonal panel.

2. The blank of claim 1, wherein the blank is configured so that when formed into the container, the first major diagonal panel extends at an obtuse angle relative to the front panel.

3. The blank of claim 1, wherein the blank is configured so that when formed into the container, the first minor diagonal panel extends at an acute angle relative to the first bottom side panel.

4. The blank of claim 1, wherein the first major diagonal panel has a first length measured between the first fold line and the first terminal edge, and the first minor diagonal panel has a second length measured between the second fold line and the second terminal edge, the first length being greater than the second length.

5. The blank of claim 1, further comprising a first corner panel positioned between the first major diagonal panel and the bottom panel.

6. The blank of claim 5, wherein the first corner panel is hingedly connected to the first major diagonal panel, the first minor diagonal panel, and the bottom panel.

7. The blank of claim 6, wherein the blank is configured so that when formed into the container, the first corner panel is positioned in overlapping relationship with the bottom panel.

8. The blank of claim 1, further comprising a first overlap flap extending from said first terminal edge.

9. The blank of claim 8, wherein said first overlap flap is positionable to overlap at least a portion of said first minor diagonal flap.

10. A container formed from a blank of foldable sheet material and enclosing an interior volume, the container comprising:

a top wall;

a first top side panel hingedly connected to said top wall along a first side edge of said top wall;

a bottom wall comprising a bottom panel;

a first bottom side panel hingedly connected to said bottom panel along a first side edge of said bottom panel;

a front wall comprising a front panel hingedly connected to a front edge of said bottom wall;

a first major diagonal panel connected to a first side edge of said front panel along a first fold line and extending to a first terminal edge proximate an inside surface of the first bottom side panel so as to define a gap between said first terminal edge and said inside surface of said first bottom side panel, said gap configured to receive a portion of said first top side panel when the container is closed; and a first minor diagonal panel hingedly connected to a front edge of said bottom side panel along a second fold line and extending to a second terminal edge, wherein the second terminal edge contacts an outside surface of the first major diagonal panel.

11. The container of claim 10, wherein the first major diagonal panel extends at an obtuse angle relative to the front panel.

12. The container of claim 10, wherein the first minor diagonal panel extends at an acute angle relative to the first bottom side panel.

13. The container of claim 10, wherein the first major diagonal panel has a first length measured between the first fold line and the first terminal edge, and the first minor diagonal panel has a second length measured between the second fold line and the second terminal edge, the first length being greater than the second length.

14. The container of claim 10, further comprising a first corner panel positioned between the first major diagonal panel and the bottom panel.

15. The container of claim 14, wherein the first corner panel is hingedly connected to the first major diagonal panel, the first minor diagonal panel, and the bottom panel.

16. The container of claim 15, wherein the first corner panel is positioned in overlapping relationship with the bottom panel.

17. The container of claim 10, further comprising a first overlap flap extending from said first terminal edge.

18. The container of claim 17, wherein said first overlap flap is positioned so as to overlap at least a portion of said first minor diagonal flap.

* * * * *